United States Patent [19]

Erickson

[11] Patent Number: 4,817,393

[45] Date of Patent: Apr. 4, 1989

[54] COMPANDED TOTAL CONDENSATION LOXBOIL AIR DISTILLATION

[76] Inventor: Donald C. Erickson, 1704 S. Harbor La., Annapolis, Md. 21401

[21] Appl. No.: 853,461

[22] Filed: Apr. 18, 1986

[51] Int. Cl.[4] ..... F25D 3/04

[52] U.S. Cl. ..... 62/22; 62/27; 62/31; 62/34; 62/38

[58] Field of Search ..... 62/11, 22, 23–24, 62/27–28, 31, 36, 38–39, 42, 34

[56] References Cited

U.S. PATENT DOCUMENTS

| | | | |
|---|---|---|---|
| 3,079,759 | 3/1963 | Schilling | 62/22 X |
| 3,210,951 | 10/1965 | Gaumer, Jr. | 62/39 X |
| 3,447,331 | 6/1969 | Smith | 62/22 X |
| 4,137,056 | 1/1979 | Galavko | 62/29 X |
| 4,279,631 | 7/1981 | Skolaude | 62/38 X |
| 4,356,014 | 10/1982 | Higgins | 62/28 |
| 4,410,343 | 10/1983 | Ziemer | 62/31 X |
| 4,433,989 | 2/1984 | Erickson | 62/34 X |
| 4,464,191 | 8/1984 | Erickson | 62/42 X |
| 4,533,375 | 8/1985 | Erickson | 62/22 |
| 4,543,115 | 9/1985 | Agrawal et al. | 62/34 X |
| 4,582,518 | 4/1986 | Erickson | 62/28 X |
| 4,604,116 | 8/1986 | Erickson | 62/42 X |
| 4,605,427 | 8/1986 | Erickson | 62/22 |
| 4,615,716 | 10/1986 | Cormier et al. | 62/22 X |
| 4,670,031 | 6/1987 | Erickson | 62/31 X |

FOREIGN PATENT DOCUMENTS 756150 8/1980 U.S.S.R. .

OTHER PUBLICATIONS

C. Judson King, "Separation Processes", McGraw-Hill Book Co., 1980, pp. 221 and 235.

Latimer, "Distillation of Air", Chemical Engineering Progress (vol. 63, No. 2), Feb. 1967, pp. 35–59.

*Primary Examiner*—Steven E. Warner

[57] ABSTRACT

The invention discloses method and apparatus for achieving higher $O_2$ delivery pressure coupled with high product recovery in cryogenic air distillation plants, without additional power consumption. Products include high purity oxygen plus coproduct argon, or medium purity oxygen plus optional coproduct nitrogen. Compander driven compressor (5) boosts the pressure of a minor fraction of air which totally condenses to evaporate LOX in evaporator (6), and liquid air is split into 2 intermediate refluxes.

10 Claims, 3 Drawing Sheets

COMPANDED TOTAL CONDENSATION LOXBOIL AIR DISTILLATION

DESCRIPTION

1. Technical Field

This invention relates to processes and apparatus for separating air by cryogenic fractional distillation to produce gaseous oxygen of 90 to 99.8% purity, plus optional co-product argon or nitrogen. The invention permits high $O_2$ production pressure without offsetting decreases in product purity or recovery. Oxygen is useful in the production of iron, steel, electricity (coal gasification combined cycle), and in many other applications.

2. Background Art

Cryogenic air separation processes usually incorporate a dual pressure or double column arrangement of distillation columns, wherein compressed, cleaned, and cooled feed air is supplied to a high pressure rectifier; the liquid bottom product (kettle liquid) is fed to a low pressure distillation column; a latent heat exchanger provides overhead reflux to the HP rectifier and reboil (either bottom or intermediate) to the LP column; and the LP column is refluxed by direction injection of HP rectifier overhead liquid nitrogen ($LN_2$) product. Historically, the gaseous $O_2$ product has usually been generated by latent heat exchange with HP rectifier overhead nitrogen, as shown for example in "Distillation of Air" by R. E. Latimer, *Chemical Engineering Progress* Volume 63 No. 2 Feb. 1967, published by AIChE, New York. Given HP rectifier nitrogen at a typical pressure of 88 psia (6 atmospheres absolute) and a latent head exchanger temperature differential of 3° F. (1.67K), this establishes the oxygen boiling or evaporating conditions of 23.2 psia and −289° F.

There has been a continuing search for reliable, economical, and efficient means for increasing the oxygen evaporation pressure beyond that achievable from heat exchange with condensing HP rectifier nitrogen. These efforts have fallen mainly into three categories, as follows:

a. Pumped LOX

In this category, the liquid oxygen (LOX) is pumped to the desired delivery pressure, and a fraction of the supply air (25 to 35%) is additionally compressed with an externally powered compressor sufficient to exchange latent heat with the evaporating LOX. This approach and the attendant problems are described in copending application Ser. No. 583,817 filed Feb. 27, 1984 by Donald C. Erickson now U.S. Pat. No. 4,604,116, and the references cited therein, which are incorporated by reference. Prior art U.S. patents include U.S. Pat. Nos. 3,110,155 and 4,372,764.

b. TC LOXBOIL

This variation of Pumped LOX does not required an additional externally-powered compressor. The 25 to 30% of the feed air which totally condenses to evaporate the liquid oxygen is at the same general pressure as the feed air. Since the bubble point of air at a given pressure is about 4° F. warmer than the saturation temperature of nitrogen at the same pressure, the evaporating oxygen is also 4° F. warmer. This would increase the above cited 23 psia to 28 psia. Prior art examples of this technique include U.S. Pat. Nos. 3,277,655, 4,133,662, and Russian Pat. No. 756150.

c. PC LOXBOIL

The partial condensation liquid oxygen boil (PC LOXBOIL) approach varies from TC LOXBOIL in that all or a major fraction of the feed air (at feed pressure) is passed through the LOXBOIL heat exchanger, and hence only a minor fraction of the air condenses. Since the exiting vapor and liquid are in equilibrium, the liquid composition will be about 35% $O_2$, and the vapor about 17.5% $O_2$, as contrasted to the 21% $O_2$ liquid (liquid air or "LAIR") obtained with TC LOXBOIL. The bubble point of 35% $O_2$ in $N_2$ liquid is about 7° F. hotter than Tsat of $N_2$ at the same pressure. A 7° F. increase in evaporating temperature would increase the previously cited 23 psia oxygen to 32.3 psia. Prior art examples incorporating PC LOXBOIL include U.S. Pat. Nos. 3,327,489, 3,251,190, 3,371,496, and 4,560,398. The latter patent states that TC LOXBOIL is undesirable (p. 5 lines 65).

The use of companders (close coupled compressor and expander) is known generally in cryogenic plants and specifically in air separation plants. The vapor expander used to generate refrigeration in low pressure gaseous oxygen plants generates shaft work approximating 2 to 3% of the main air compressor power. There is little cost different between driving a small, warm end air compressor or an electrical generator with that shaft output. Prior art examples of cryogenic air separation companders using the refrigeration expander as driving end and a warm air compressor as driven end include U.S. Pat. Nos. 3,261,128, 4,375,367, 4,133,662, and Russian Pat. No. 756150. The latter two illustrate companded TC LOXBOIL, i.e. the warm air which is further compressed in the compander is then used for TC LOXBOIL. The additional pressure of the companded air raises its bubble point to 7 to 9° F. higher than that of $N_2$ at HP rectifier pressure, and hence $O_2$ evaporation pressures equal to or greater than those of PC LOXBOIL are obtained by companded TC LOXBOIL.

Copending application Ser. No. 728,264 filed Apr. 29, 1985 by Donald C. Erickson now U.S. Pat. No. 4,670,031, which is incorporated by reference, discloses a means of increasing the recovery of crude argon from a dual pressure column by increasing the reboil rate up the lower portion of the argon sidearm column and correspondingly decreasing the reboil rate up a section of the nitrogen stripping stages of the pressure column. This effect is accomplished by exchanging latent heat from an intermediate height of the argon sidearm to an intermediate height of the nitrogen stripping section of the low pressure column. Patent Cooperation Treaty No. Application PCT/US84/00862 filed on June 6, 1985 corresponding to U.S. Pat. No. 4,605,427 describes a related technique of increasing argon recovery from triple pressure columns.

U.S. Pat. No. 3,729,943 discloses a high purity oxygen plus argon configuration in which the argon sidearm is refluxed both at the top and at the bottom by latent heat exchange. The evaporating fluid may be $N_2$, which is subsequently expanded. Application Ser. No. 728,264 now U.S. Pat. No. 4,670,031 discloses providing intermediate reflux to an argon sidearm by $N_2$ evaporation, plus subsequent work expansion.

The problems with the prior art methods of increasing $O_2$ pressure without providing additional compression energy input are as follows. All of the LOXBOIL variations, with the exception of the above cited application Ser. No. 583,817 now U.S. Pat. No. 4,609,116, share a common problem: limited availablility of $LN_2$ for column reflux. Less vapor fed to the HP rectifier inescapably means less $LN_2$ overhead product. For some air separation processes this does not pose a problem, because the requirement for $LN_2$ reflux is inherently low. For example, conventional medium purity $O_2$ plants (90 to 99% purity) with no argon coproduct and no significant amount of pressurized $N_2$ by product have adequate $LN_2$ reflux for 95+% recovery of $O_2$ even when LOXBOIL is used. Such plants are thus the ones disclosed in U.S. Pat. Nos. 4,133,662, 4,560,398, 3,251,190, and Russian Pat. No. 756150. Other processes, however, require more $LN_2$ reflux than that available from the prior art LOXBOIL disclosures, and, as a result, if LOXBOIL were applied to those processes, the $LN_2$ reflux deficiency would cause product recovery to decline to such an extent that the increase in $O_2$ delivery pressure has less value than the loss. Examples of processes which would suffer from the application of known LOXBOIL techniques are as follows:

(i) High purity oxygen plus argon

Argon is recovered in a sidearm column which is refluxed by evaporating part of the kettle liquid. It can readily be demonstrated on a McCabe-Thiele diagram that the more evaporated the feed to the LP column (the kettle liquid), the larger the minimum reflux requirement for that column. See for example p. 221 and p. 235 of "Separation Processes", second edition, by C. J. King, McGraw Hill, New York, 1980. Thus high purity oxygen plus argon plants inherently require more $LN_2$ reflux than do medium purity plants in order to achieve full (95+%) $O_2$ recovery, and the $LN_2$ reflux available from prior art TC LOXBOIL disclosures is not adequate for that purpose. This may be why not prior art disclosure of TC LOBOIL cites production of high purity oxygen plus argon.

(ii) Pressurized $N_2$ coproduct

Any gaseous $N_2$ withdrawn from the HP rectifier as product also decreases the amount of $LN_2$ reflux available. Thus even the prior art LOXBOIL flowsheets will begin to lose recovery if more than a nominal amount, say about 5%, of pressurized $N_2$ is withdrawn.

(iii) Very low pressure medium purity plants

In some plants the HP rectifier overhead reboils an intermedite height of the LP column, not the bottom. The bottom is reboiled by condensing air. This further reduces the amount of vapor supplied to the HP rectifier (beyond the reduction due to LOXBOIL), and hence further reduces the amount of $LN_2$ reflux available. Examples of this kind of plant incorporating either TC or PC LOXBOIL are in U.S. Pat. Nos. 3,277,644, 3,327,489, and 3,371,496. It can be inferred that the limited use of these plants to date is at least partly due to the low $O_2$ recoveries achieved due to the reduced availability of $LN_2$ caused by TC or PC LOXBOIL.

What is needed, and the primary objective of this invention, is a method and apparatus for obtaining the high $O_2$ delivery pressure advantage of compressed or companded TC LOXBOIL dual pressure air separation while avoiding the offsetting disadvantage of reduced product recovery and/or purity encountered in all prior art disclosures.

DISCLOSURE OF INVENTION

The above and other useful advantages are obtained from a unique combination of steps (process) or apparatus as follows: In a dual pressure $O_2$ gas-producing air distillation plant comprised of HP rectifier and LP column with $N_2$ rectifying section, liquid oxygen is evaporated by latent heat exchange with a minor fraction of the feed air which is at a pressure at least as high as the HP rectifier pressure, and substantially all of the minor fraction of air is as a result condensed. The resulting liquid air is split into at least two streams, one of which is supplied as intermediate reflux to the HP rectifier, and the other is supplied as intermediate reflux to the $N_2$ rectifying section of the LP column, preferably after subcooling. At least 15% of the LAIR is supplied to each intermediate reflux location, and the preferred distribution is about one-third to the LP column and two-thirds to the HP rectifier. The LAIR split can be effected by the coordinated action of two control valves controlling the respective liquid streams. The split proportions of the LAIR intermediate reflux are chosen so as to minimize the combined need for $LN_2$ reflux to the two columns. Thus the otherwise harmful effects of insufficent $LN_2$ reflux are unexpectedly avoided by the disclosed novel combination of steps.

The minor fraction of air which is substantially totally condensed is preferably at a pressure greater than HP rectifier pressure, in order to further increase $O_2$ production pressure. The added air pressure is preferably provided by a compander with a warm end air compressor which is driven by the refrigeration expander. Either air or $N_2$ may be expanded. By using the compander, no additional input of external power is required to obtain the pressure increase.

The above improved combination of steps has general utility in any dual pressure air distillation arrangement. However, the advantages are especially significant in flowsheets for producing high purity (99.5+%) oxygen plus coproduct argon; flowsheets for producing medium purity (90 to 99%) $O_2$ plus substantial amounts of coproduct $N_2$; and flowsheets for producing medium purity $O_2$ using very low supply pressure (less than 4.5 ATA).

When producing high purity oxygen plus coproduct argon, it is further referred to incorporating a means to increase argon recovery comprised of means for exchanging latent heat between argon recitfying section (sidearm) vapor from above a zone of counter-current vapor-liquid contact, and liquid from an intermediate height of the nitrogen stripping section of the LP column (heat flow from rectifying to stripping section). Additionally or alternatively the argon recovery can also be increased by partially depressurizing part of the liquid nitrogen overhead product from the HP rectifier, evaporating it at an intermediate pressure by exchanging latent heat with vapor from above a zone of counter-current vapor-liquid contact in the argon sidearm; and work expanding the evaporated nitrogen with said work preferably powering said compressor for said minor fraction of air.

BEST MODE FOR CARRYING OUT THE INVENTION

Figure 1:
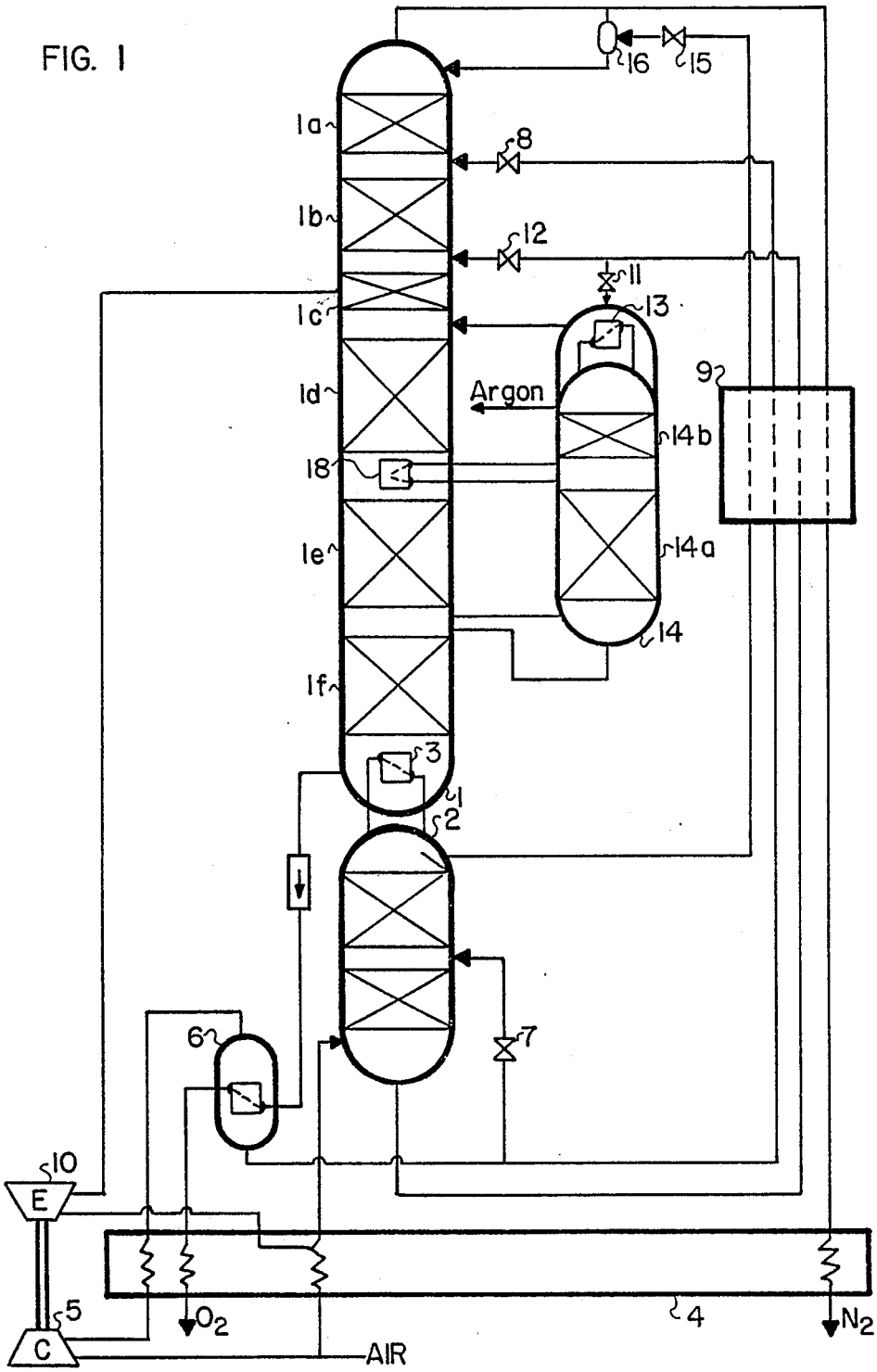
FIG. 1 is a simplified schematic flowsheet of an embodiment of the invention which is adapted for producing high purity oxygen plus coproduct argon.

Referring to FIG. 1, low pressure column 1 and high pressure rectifier 2 jointly comprise a dual pressure column. Latent heat exchanger 3 condenses HP rectifier overhead vapor and reboils the LP column bottom. Compressed, dried and cleaned air is split, with a major fraction being cooled to near the dewpoint in main exchanger 4. The remaining minor fraction (about 25 to 30% of the total) is further compressed in compressor 5 while still near ambient temperature and then is cooled—first optionally by ambient cooling, and then by heat exchange with product exiting the cold box, e.g., as in main exchanger 4. After cooling to near its dewpoint, the minor fraction is substantially totally condensed in LOX evaporator 6. The liquid air is split into two streams, one being injected to an intermedite height of the HP rectifier by control valve 7, and the other to an intermediate reflux height of the LP column 1 by control valve 8, preferably after subcooling in sensible heat exchange 9.

A small part of the major air stream may be separated when only partially cooled and routed to expander 10 where it is expanded to LP column pressure and also produces work. The work is used to power compressor 5, preferably closedly coupled in a compander configuration. The remaining major fraction is rectified in the HP rectifier to $LN_2$ overhead and kettle liquid bottoms. The kettle liquid is subcooled in 9, and then preferably split by coordinated action of control valves 11 and 12, with part being evaporated by latent heat exchanger 13 before being fed to the LP column, and the remainder fed directly, at a higher tray height. The exhaust air from expander 10 is also fed to the LP column at the same approximate height as the kettle liquid.

The LP column has zones of counter-current vapor-liquid contact both above and below the feed location(s). Contact zones 1*a* and 1*b* are nitrogen rectifying zones; the liquid air through control valve 8 is intermediate reflux because it is introduced between zones 1*a* and 1*b*, i.e., because there are zones of nitrogen rectification via counter-current vapor-liquid contact both above and below it. Below the feed zone 1c are the nitrogen stripping zones 1*d* and 1*e*. Substantially nitrogen free vapor comprised of oxygen and argon from below zone 1*e* communicates with argon rectifier ("sidearm") 14, and bottom liquid from argon rectifier 14 returns to column 1. Below zone 1*e* is zone of counter-current vapor-liquid contact 1*f*, wherein argon stripping occurs. The argon sidearm 14 is refluxed by reflux condenser 13, and crude argon overhead product is withdrawn in either vapor or liquid phase for further processing. Part of the liquid nitrogen from the HP rectiier overhead condenser 3 is subcooled, depressurized by valve 15, optionally phase separated in 16, and then directly injected as reflux into the LP column overhead. Gaseous nitrogen from there is warmed in exchangers 9 and 4 and exhausted. Liquid oxygen of product purity from the LP column bottom is further pressurized and routed to LOX evaporator 6 by means of one way flow 17, e.g., a pump or a check valve. Since the $O_2$ pressure in evaporator 6 will preferably be about 10 to 13 psi higher than at the bottom of LP column 1, the hydrostatic head associated with a barometric leg of liquid oxygen between 20 and 26 feet high will be sufficient to generate the added pressure. Thus using a barometric leg can eliminate the need for other means of LOX pressurization such as a LOX pump. Finally product gaseous oxygen is withdrawn from evaporator 6.

In order to achieve increased argon recovery, FIG. 1 also incorporates latent head exchanger 18. This exchanger provides intermediate reboil to the nitrogen stripping section of column 1 owing to its functional location between contact zones 1*d* and 1*e*, i.e., at an intermediate height of the nitrogen stripping section. Of course, the actual physical location need not be inside column 1 as depicted. The condensing vapor which provides the intermediate reboil at 18 is taken from sidearm 14 above a zone of counter-current vapor-liquid contact (14*a*). The location may be either intermediate or at the top of sidearm 14, depending on whether contact zone 14*b* is present or not. More argon recovery is achieved when zone 14b is deleted, but heat exchanger 18 temperature differential is correspondingly decreased.

The split proportions of the liquid air are of critical importance to the successful achievement of the disclosed advantages from this invention, both for FIG. 1 and for all other embodiments. This is because whereas a little bit of intermediate reflux is always helpful, too much can be as bad as or even worse than none at all. LOXBOL necessarily causes a substantial quatity of liquid air to be available, on the order of 0.28 moles per mole of compressed air (m/mca). Without a split, i.e., if all were fed to either the LP column or HP rectifier as disclosed in the prior art, the recovery would be comparable to or even worse than that from PC LOXBOIL. It can be inferred that this is the reason U.S. Pat. No. 4,560,398 states the TC LOXBOIL is undesirable. Surprisingly, however, if at least about 15% of the liquid air is fed as intermediate reflux to each $N_2$ rectification, the recovery exceeds that from PC LOXBOIL. That is to say, the two liquid air stream flowrates should be within a factor of about six of each other. If the split is further optimized, then substantial additional product recovery becomes possible with TC LOXBOL: high purity $O_2$. coproduct argon, or other product increases. The exact proportions of the optimal liquid air split are not at all critical, but generally fall between 1 to 1 and 2.5 to 1, and will vary depending on the flowsheet. For example at least approximately 2% more high purity oxygen can be recovered than with PC LOXBOIL. If in addition companding is used with TC LOXBOIL, the $O_2$ delivery pressure will be equal to or greater than that from PC LOXBOIL.

The means for accomplishing counter-current vapor-liquid contact may be any known in the art: sieve trays, bubble caps, packing (random or structured), wire mesh, and the like.

Figure 2:
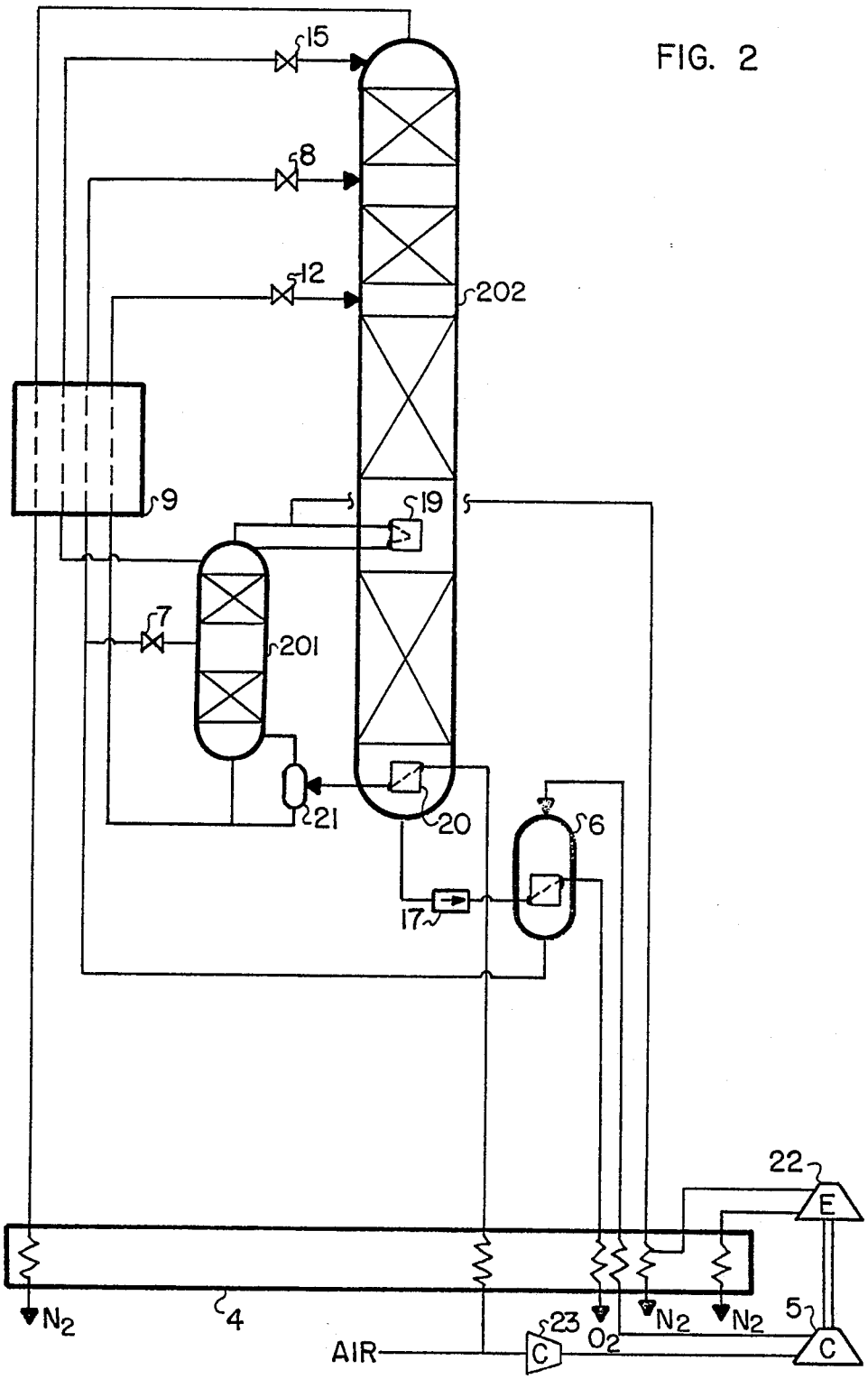
FIG. 2 depicts an embodiment incorporating a nested double column so as to achieve a very low supply pressure, i.e., the HP rectifier reboils an intermediate height of the LP column, and which incorporates companded TC LOXBOIL plus two intermediate refluxes by split liquid air in order to improve recovery.

Referring to FIG. 2, HP rectifier 201 reboils LP column 202 at an intermediate height via latent heat exchanger 19. The LP column bottom reboil is via partial condensation of a major fraction of the supply air in latent heat exchanger 20. Phase separator 21 (optional) removes the condensate from that stream. Since the liquid is of the approximate composition of kettle liquid, it is normally combined with the kettle liquid. Components 4, 5, 6, 8, 9, 12, 15, and 17 are described similarly as in FIG. 1. FIG. 2 depicts refrigeration via $N_2$ expansion vice air as in FIG. 1. Either method is approximately equivalent in overall results. A small stream (about 0.1 to 0.15 m/mca) of gaseous nitrogen is withdrawn from the HP rectifier overhead, partially warmed, and then work expanded in $N_2$ expander 22, which powers compressor 5. If desired, the minor air fraction (TC LOXBOIL fraction) can be further compressed by externally powered compressor 23, including optional ambient cooling, to further increase the $O_2$ delivery pressure. This option is particularly advantageous when the need for a separator $O_2$ compressor can be eliminated.

Column 202 of FIG. 2 has 2 refluxes and 2 reboils, and rectifier 201 has 2 refluxes. By adjusting the relative heat duties of exchangers 19 and 20, and optimizing the liquid air split via valves 7 and 8, the operating lines of each column are caused to closely approach their equilibrium lines, i.e., very efficient column operation is achieved. This results in high recovery (95+%) of medium purity oxygen using a supply air pressure of only about 4.5 ATA, plus a delivery pressure of about 20 psia (or higher if an externally powered boost air compressor is incorporated). These results are unique, advantageous, and unexpected in view of the prior art.

Figure 3:
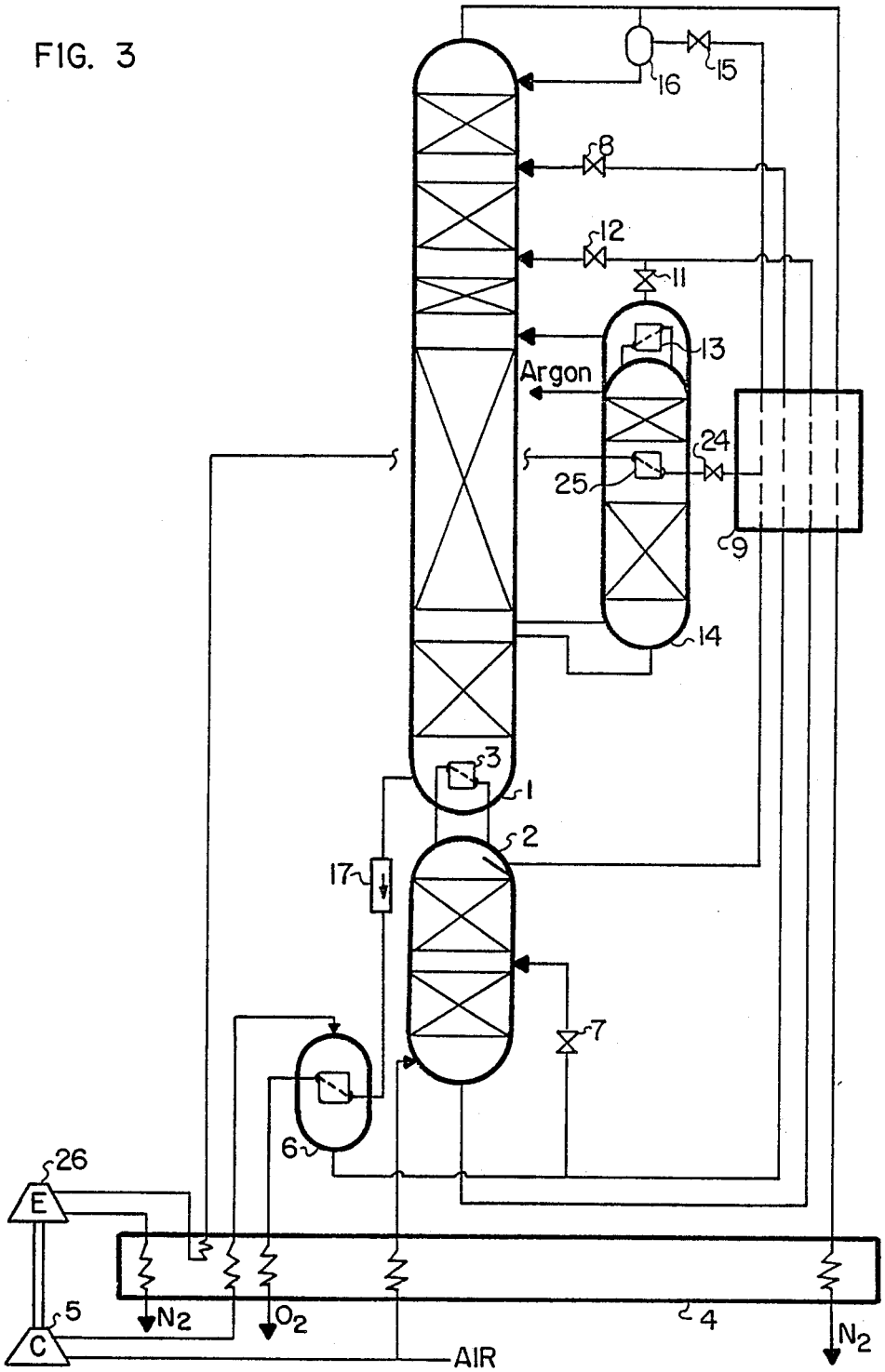
FIG. 3 is a high purity oxygen plus coproduct argon flowsheet analogous to FIG. 1, except that argon recovery is increased by refluxing the argon sidearm by latent heat exchange with liquid nitrogen, and then work expanding the gaseous $N_2$.

Referring to FIG. 3, another embodiment of the inventive entity of companded TC LOXBOIL plus LAIRSPLIT into two separate intermediate refluxes is disclosed. FIG. 3 is for production of high purity oxygen plus coproduct crude argon as FIG. 1. Components 1 to 9 and 11 to 16 have the same description as in FIG. 1. FIG. 3 incorporates an alternative means of increasing argon recovery to that disclosed in FIG. 1 (latent heat exchanger 18). In FIG. 3, part of the liquid nitrogen is partially depressurized by valve 24 and then evaporated in latent heat exchanger 25, which provides reflux to at least part of argon sidearm 14. The evaporated nitrogen, at a pressure between that of the HP rectifier and the LP column, is then work expanded in expander 26. The latter expander is preferably the only one present, and preferably used to drive compressor 5.

The high purity $O_2$ flowsheets can utilize air expansion refrigeration as per FIG. 1, nitrogen expansion refrigeration as per FIG. 2, or partially depressurized nitrogen expansion as per FIG. 3. The latter has the advantages of increased reboil through the argon stripper and the argon rectifier. The disadvantages are larger flow through the expander (almost double, e.g., 0.2 m/mca) and reduced $LN_2$ reflux available. By careful optimization of the LAIRSPLIT, full $O_2$ recovery can still be maintained, in addition to the increased reboil advantages. If will be recognized that the other method of increasing argon recovery—latent heat exchanger 18—could additionally be incorporated in FIG. 3 for even more argon recovery.

Other variations and combinations of the disclosed novel features will be apparent to the artisan, and will fall within the scope of the claims, which are not limited to only the preferred embodiments described above.

I claim:

1. A dual pressure cryogenic distillation process for producing gaseous oxygen from a supply of compressed and cleaned air comprising:

a. cooling a major fraction of said compressed and cleaned air:

b. rectifying said major fraction in a high pressure rectifier to liquid nitrogen overhead product and kettle liquid bottom product;

c. distilling the kettle liquid in a low pressure column to liquid oxygen bottom product and gaseous nitrogen overhead product;

d. working expanding a compensating vapor comprised of at least 77% $N_2$ thereby producing refrigeration;

e. further compressing the remaining minor fraction comprising no more than about 30% of said compressed, cleaned warm air in a compressor powered by said expansion work;

f. pressurizing said liquid oxygen to at least about 0.2 ATA above LP column bottom pressure;

g. cooling the minor air fraction to near its dewpoint;

h. condensing substantially all the minor air fraction by exchanging latent heat with said pressurized liquid oxygen;

i. withdrawing evaporated oxygen as product;

j. dividing the condensed air into two streams, each comprising at least 15% of said minor fraction;

k. injecting one of said streams into an intermediate height of the HP rectifier and injecting the second stream into an intermediate height of the LP column; and l. separately reboiling said LP column bottoms by exchanging latent heat with at least one of:

(i) HP rectifier overhead vapor and (ii) partially condensing major fraction of said supply air.

2. Process according to claim 1 further comprising subcooling said second liquid air stream before injection into said LP column.

3. Process according to claim 2 further comprising separating a partially cooled minor substream of air from said major fraction and providing it to said work-expanding step.

4. Process according to claim 2 further comprising providing HP rectifier gaseous overhead $N_2$ to said work-expanding step.

5. Process according to claim further comprising withdrawing at least 0.05 moles $N_2$ per mole of compressed air from the HP rectifier overhead as coproduct.

6. Process according to claim 2 further comprising reboiling the bottom of said LP column by partial condensation latent heat exchange with said cooled major air fraction; and reboiling an intermediate height of said LP column by latent heat exchange with HP rectifier overhead gaseous nitrogen.

7. Process according to claim 2 further comprising evaporating part of said kettle liquid prior to said distillation and thereby providing reflux to an argon sidearm.

8. Process according to claim 7 further comprising exchanging latent heat between vapor from above a zone of counter-current vapor-liquid contact in said argon sidearm and an intermediate height of the $N_2$ stripping section of said LP column.

9. Process according to claim 7 further comprising partially depressurizing part of the liquid nitrogen overhead product from said HP recitifer; evaporating it by exchanging latent heat with vapor from above a zone of counter-current vapor-liquid contact in said argon sidearm; and returning liquid reflux to said sidearm.

10. Process according to claim 9 further comprising providing said evaporated $N_2$ to said work-expanding step.

* * * * *